US011036167B2

(12) United States Patent
Ohshima

(10) Patent No.: US 11,036,167 B2
(45) Date of Patent: Jun. 15, 2021

(54) HEATER FIXING HOLDER, METHOD OF FIXING AND HOLDING HEATER, FIXING DEVICE, AND IMAGE FORMING APPARATUS

(71) Applicant: Hironori Ohshima, Kanagawa (JP)

(72) Inventor: Hironori Ohshima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/750,085

(22) Filed: Jan. 23, 2020

(65) Prior Publication Data

US 2020/0249605 A1 Aug. 6, 2020

(30) Foreign Application Priority Data

Feb. 1, 2019 (JP) ..... JP2019-016936

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2032; G03G 15/2035; G03G 15/2053; G03G 21/1685; G03G 2215/2003; G03G 2221/1639
See application file for complete search history.

(56) References Cited

U.S. PATENT DOCUMENTS 5,301,000 A * 4/1994 Heigl ..... G03G 15/2064 219/216
2017/0269522 A1* 9/2017 Kubota ..... G03G 15/2028
2018/0004137 A1 1/2018 Ohshima

FOREIGN PATENT DOCUMENTS

JP 2002-278336 9/2002
JP 2007-310377 11/2007

* cited by examiner

*Primary Examiner* — Thomas S Giampaolo, II
(74) *Attorney, Agent, or Firm* — Oblon, McClelland, Maier & Neustadt, L.L.P.

(57) ABSTRACT

A heater fixing holder is configured to be detachably attached on a heating roller and a heater inside the heating roller. The heating roller constitutes part of a fixing device configured to fix an image onto a recording medium. The heater fixing holder includes a fitting portion configured to be penetrated with and fit with an end portion of the heater and a gripping portion configured to hold an outer peripheral surface of the heating roller. The heater fixing holder is configured to hold and fix the heater at a position at which the heater does not contact an inner wall of the heating roller.

8 Claims, 4 Drawing Sheets

HEATER FIXING HOLDER, METHOD OF FIXING AND HOLDING HEATER, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-016936, filed on Feb. 1, 2019, in the Japan Patent Office, the entire disclosure of which is hereby incorporated by reference herein.

BACKGROUND

Technical Field

The present disclosure relates to a heater fixing holder, a method of fixing and holding a heater, and an image forming apparatus including a fixing device and the heater fixing holder.

Description of the Related Art

A heat fixing system is widely used among electrophotographic image forming apparatuses, such as copiers, facsimile machines, and printers. Such electrophotographic image forming apparatuses include a fixing device having a heat generation source. The fixing device heats an unfixed image (toner image) formed on a recording medium such as a paper sheet to fix the image on the recording medium.

For example, a belt fixing system for the fixing device is known. In the belt fixing system, the fixing device includes a fixing roller and an endless fixing belt. The fixing roller is disposed facing a pressure roller serving as a pressing member. The endless fixing belt serves as a fixing member stretched over the fixing roller and a heating roller having a heat generation source. The pressure roller is pressed against the fixing belt to form a nip portion in which the heat is transmitted from the heating roller to a recording medium via the fixing belt to press and fix an unfixed toner image onto the recording medium.

The heating roller is a hollow pipe in which the heat generation source (hereinafter referred to as "heater") such as a heating lamp is disposed. In general, the thermal capacity for fixing a toner image increases in an image forming apparatus capable of high-speed printing or an image forming apparatus supporting high ream weight sheets. Therefore, a plurality of heat generation sources may be provided to heat the heating roller to a high temperature.

When a plurality of heat generation sources is provided, the heat generation sources are disposed in proximity around the central axis to uniformly heat the entire surface of the heating roller.

However, when the plurality of heat sources is arranged close to each other, end portions of the heat generation sources are also arranged close to each other. Thus, handling of the extended lead wires and the like becomes complicated, resulting in difficulty in assembling the fixing device, undesirably.

When an operator attaches and detaches the heat generation sources, attaching and detaching operations become complicated due to the handling of attached connectors, harnesses, and the like.

Further, since the heater generally has an elongated rod shape, the heater may contact an inner wall or an edge of the heating roller during attachment and detachment, and a surface of the heater may be scratched or damaged by the contact, undesirably.

On the other hand, when other members constituting part of the fixing device other than the heater are replaced, an operation to detach the heater from the heating roller is performed to prevent the heater from contacting an inside of the heating roller and being damaged.

As described above, there is a need for a technology that prevents damage to the heater when replacing the heater itself or replacing the heater accompanied by a replacement of the members constituting the fixing device. In replacing the members other than the heater, if the damage can be prevented without detaching the heater, the attachment and detachment can be omitted and the work efficiency can be improved.

SUMMARY

In an aspect of the present disclosure, a heater fixing holder is configured to be detachably attached on a heating roller and a heater inside the heating roller. The heating roller constitutes at least part of a fixing device configured to fix an image onto a recording medium. The heater fixing holder includes a fitting portion configured to be penetrated with and fit with an end portion of the heater and a gripping portion configured to hold an outer peripheral surface of the heating roller. The heater fixing holder is configured to hold and fix the heater at a position at which the heater does not contact an inner wall of the heating roller.

In another aspect of the present disclosure, a method of fixing and holding a heater with the heater fixing holder includes attaching the heater fixing holder to the heater disposed inside a heating roller of a fixing device that fixes an image onto a recording medium and fixing and holding the heater at a position at which the heater does not contact an inner wall of the heating roller.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

Descriptions are provided of a heater fixing holder, a method of fixing and holding a heater fixing device and an image forming apparatus incorporating the fixing device according to embodiments of the present disclosure with reference to drawings. Note that the present disclosure is not limited to the following embodiments. The present disclosure may include other embodiments and may be modified with, for example, addition, modification, or omission within a scope that would be obvious to one skilled in the art. Any aspects having advantages as described in the following embodiments according to the present disclosure are included within the scope of the present disclosure.

Figure 1:
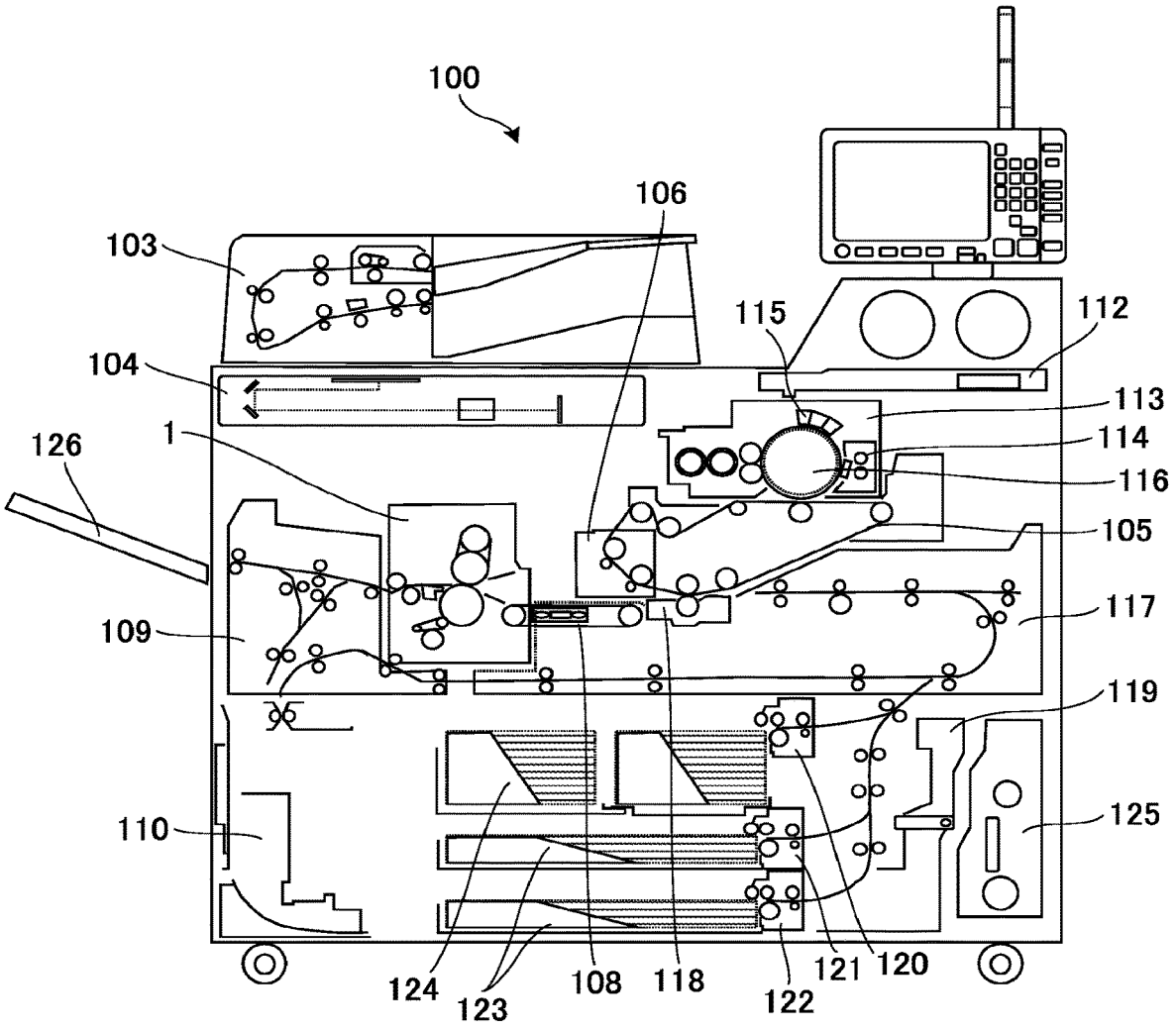
FIG. 1 is a schematic cross-sectional view of a configuration of an image forming apparatus according to an embodiment of the present disclosure.

A description is given of the image forming apparatus according to an embodiment of the present disclosure with reference to FIG. 1. FIG. 1 is a schematic view of a configuration of the image forming apparatus 100.

The image forming apparatus 100 according to the present embodiment includes a heater fixing holder removably attached to a heater and a heating roller described later.

In FIG. 1, an image reading unit 104 includes a scanner that houses an illumination device, an optical system, a charge-coupled device (CCD) image sensor, and the like. The scanner includes an exposure glass on which a document is placed, illuminates the document through the exposure glass, and reads a reflected light through the optical system with the internal CCD image sensor.

An automatic document feeder (ADF) 103 is disposed above the scanner. The ADF 103 automatically conveys the document and sends the document to an image reading surface of the exposure glass.

The image data read by the scanner is converted to an electrical signal and subject to image processing such as various processes including correction and compression. Thereafter, the image data is stored into an image memory successively.

A laser writing unit 112 includes a laser output unit, an image forming lens, and mirrors. A photoconductor 116 of an image forming system (a developing unit 113) is irradiated with a laser beam emitted by the laser writing unit 112.

A process of printing a toner image formed on the photoconductor 116 is roughly as follows.

A plurality of sheets stacked on universal trays 123 and a tandem tray 124 is fed by a first sheet feeder unit 120, a second sheet feeder unit 121, and a third sheet feeder unit 122. The sheets are then conveyed to an upstream position from the developing unit 113 by a vertical conveyance unit 119 and a sheet conveyance unit 117.

The image data stored in the image memory is written by a laser beam emitted by the laser writing unit 112 onto the photoconductor 116 of the developing unit 113 to form a toner image.

The developing unit 113 includes a cleaning unit 114 and a charger 115 around the photoconductor 116.

The toner image on the photoconductor 116 is transferred onto an intermediate transfer belt 105 and the toner image is formed on the intermediate transfer belt 105.

A sheet is conveyed by the sheet conveyance unit 117 in conjunction with the movement of the toner image. The toner image on the intermediate transfer belt 105 is transferred by a secondary transfer unit 118. The sheet on which the toner image has been transferred is conveyed by a fixing conveyance unit 108.

Thereafter, a fixing device 1 fixes the toner image onto the sheet. The sheet is ejected to an output tray 126 in case of simplex printing. A description is provided of a configuration of the fixing device 1 later.

When images are formed on both sides of a sheet, the sheet fed from each tray and on which the image is formed is reversed by a reverse passage switching claw. Owing to this mechanism, the sheet is conveyed not to the output tray 126, but conveyed to and temporarily stored in a reverse duplex print storage unit 110. The sheet is conveyed to the reverse direction (re-feeding direction) by a return conveyor and reversed with the reverse sheet ejection switching claw. Once again, the sheet is conveyed to the sheet conveyance unit 117 and ejected after an image is printed on the other side of the sheet.

Alternatively, when the sheet is reversed and ejected, the sheet reversed by switchback is sent by the reverse passage switching claw to the reverse duplex print storage unit 110 and reconveyed back to the reverse sheet ejection unit 109 and ejected outside an apparatus body of the image forming apparatus 100.

The sheet ejected from the apparatus body is ejected to the output tray 126 of the apparatus body by an output tray switching claw.

Figure 2:
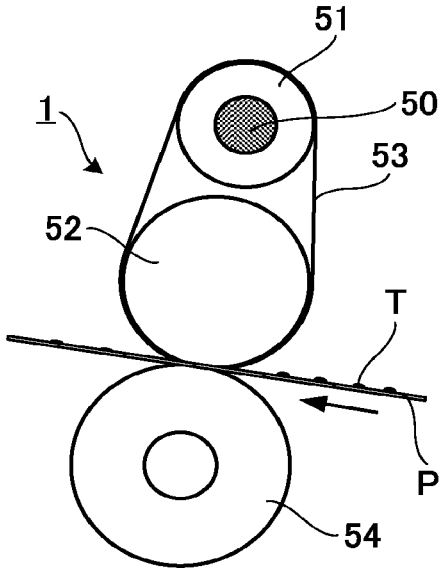
FIG. 2 is a schematic view of a part of a fixing device according to an embodiment of the present disclosure.

FIG. 2 is a schematic view of a configuration of the fixing device 1.

The fixing device 1, for example, includes a heating roller 51, a fixing roller 52, a fixing belt 53 stretched around the heating roller 51 and the fixing roller 52, and a pressure roller 54. The pressure roller 54 is pressed against the fixing roller 52 to form a nip portion between the fixing belt 53 and the pressure roller 54.

The heating roller 51 includes a heater 50 serving as a heat generation source. As the heating roller 51 and the fixing roller 52 rotate, the heating roller 51 heats an entire surface of the fixing belt 53 in a circumferential direction.

The fixing device 1 heats and fixes a toner image T onto a recording medium P while the recording medium P passes through the nip portion between the fixing belt 53 and the pressure roller 54. The pressure roller 54 is pressed against the fixing roller 52 to form the nip portion between the fixing belt 53 and the pressure roller 54. Shafts of the heating roller 51, the fixing roller 52, and the pressure roller 54 are rotatably supported on a housing of the fixing device 1 in a longitudinal direction of the housing of the fixing device 1. Drivers that drive and rotate the heating roller 51, the fixing roller 52, and the pressure roller 54, and the like are fixed to and held on the housing of the fixing device 1.

A leading end of the recording medium P having passed through the nip portion is separated by a separator (e.g., a separation plate or a separation claw) disposed on a side of the fixing roller 52 or the pressure roller 54, and ejected to a next step position.

The heating roller 51 is a thin tube made of metal, for example, and the heater 50 is disposed inside the tube.

For example, a halogen heater or a carbon heater can be employed for the heater 50. The number of heaters constituting part of the heat generation source is not limited and can be appropriately selected.

The heater fixing holder 60, described later, is attached to the heating roller 51 and the heater 50.

The fixing roller 52, accommodating no heat generation source, includes a rigid core (e.g., a core bar) made of metal such as iron and aluminum and a thick elastic layer made of silicone rubber or the like coating the core.

The fixing belt 53 is looped over and is in close contact with the fixing roller 52 and the heating roller 51. The pressure roller 54 is pressed against the fixing belt 53 at a location corresponding to the fixing roller 52, to form a nip portion between the fixing roller 52 and the pressure roller 54.

The fixing belt 53 is a multi-layer endless belt including a base layer, an elastic layer coating the base layer, and a release layer coating the elastic layer. For example, the base layer, having a layer thickness of, e.g., 90 μm, is made of polyimide (PI) resin. The elastic layer is made of silicone rubber or the like.

The elastic layer of the fixing belt 53, having a layer thickness of about 200 μm, for example, is made of an elastic material such as silicone rubber, fluoro rubber, or silicone rubber foam. The release layer of the fixing belt 53 having a layer thickness of about 20 μm, for example, is made of tetrafluoroethylene-perfluoroalkylvinylether copolymer (PFA), polyimide (PI), polyester imide (PEI), polyester sulfide (PES), or the like. The release layer serving as a surface layer of the fixing belt 53 facilitates separation or peeling-off of toner of the toner image from the fixing belt 53.

Alternatively, the fixing belt 53 may be a polyimide belt, that is, an endless film made of heat-resistant resin and having a thickness of 90 μm, for example. The surface layer of the fixing belt 53 is coated with an offset inhibitor such as PFA.

The pressure roller 54 is a roller that includes a core bar made of stainless used steel (SUS) 304 or the like and an elastic layer coating the core bar and made of fluoro rubber, silicone rubber, silicone rubber foam, or the like.

The fixing roller 52 and the pressure roller 54 are rubber rollers disposed opposite each other. As the pressure roller 54 is pressed against the fixing roller 52 toward the center of the fixing roller 52 via the fixing belt 53, the nip portion is formed between the pressure roller 54 and the fixing belt 53. Pressing force exerted from the pressure roller 54 to the fixing roller 52 is controlled to adjust the nip width.

Alternatively, when the fixing device 1 is in a standby mode or the like, preferably the pressure roller 54 may separate from the fixing roller 52.

The pressure roller 54 may include a cleaner.

The cleaner is not particularly limited as long as the cleaner removes offset toner from the pressure roller 54 even if the offset toner in a minute amount accidentally adhered to the fixing belt 53 moves to the pressure roller 54 while the toner image T is fixed.

Alternatively, the cleaner may be disposed on a side of the fixing belt 53 to remove the offset toner from the fixing belt 53.

The image forming apparatus 100 according to the present embodiment includes a waste toner tank 125 that is removably attached to the image forming apparatus 100 and collects waste toner removed from the fixing belt 53 and the like. Waste toner removed from a cleaning unit 106 for the intermediate transfer belt 105 of the image forming apparatus 100 is also collected into the waste toner tank 125. The waste toner is transported to the waste toner tank 125 by a waste-toner conveyor.

For example, the heater fixing holder 60 described later can be accommodated and held in the vicinity of a space from which the waste toner tank 125 is removed after a cover of the image forming apparatus 100 is opened.

Heater Fixing Holder and Method of Fixing and Holding Heater

A description is provided of a heater fixing holder, a method of fixing and holding a heater according to embodiments of the present disclosure with reference to FIGS. 3 to 8.

Figure 3:
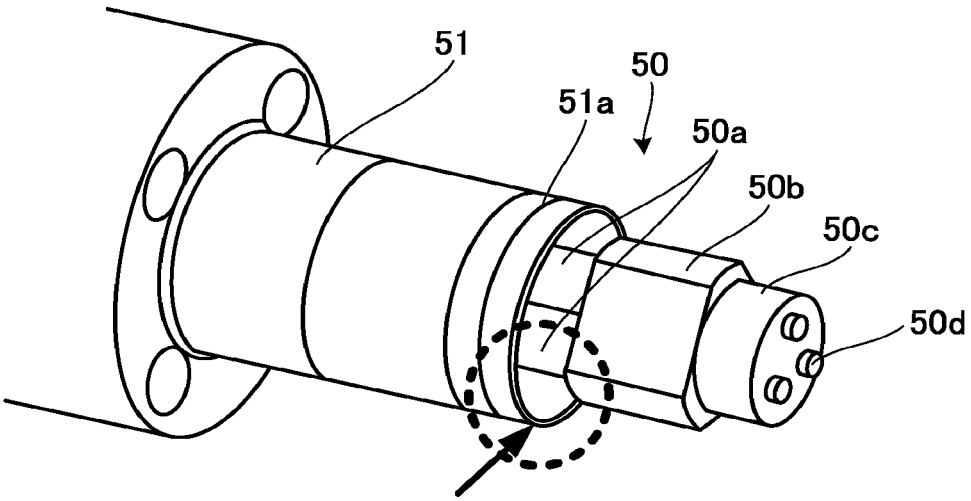
FIG. 3 is a schematic view of an example of a heating roller and a heater constituting the fixing device.
Figure 4:
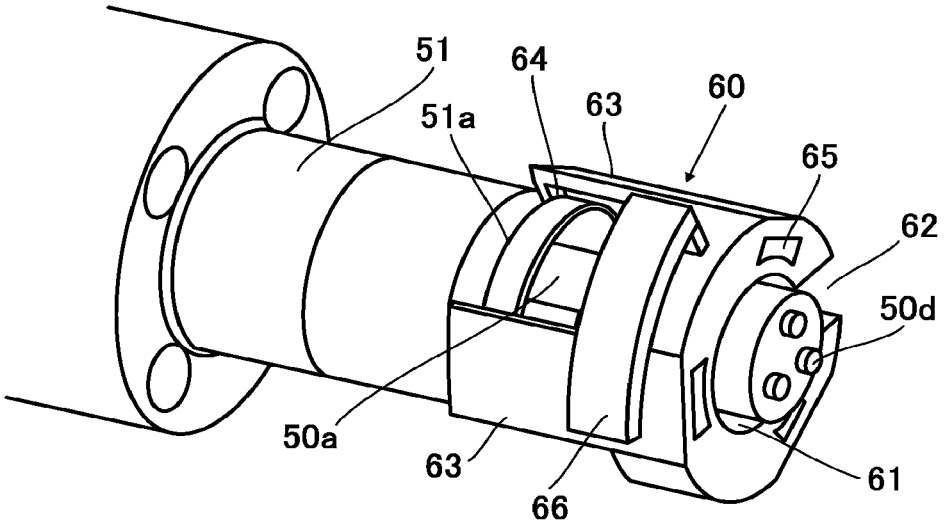
FIG. 4 is a perspective view of a state in which a heater fixing holder according to an embodiment of the present disclosure is attached to the heating roller and the heater.

FIG. 3 is a perspective view of the heating roller 51 and the heater 50 as targets to which the heater fixing holder 60 is attached. Since the heater 50 has an elongated rod shape as illustrated in FIG. 3, the heater 50 may contact an inner wall or an edge of the heating roller 51 indicated by a circle of broken line and an arrow in FIG. 3 during attachment and detachment. FIG. 4 is a perspective view of a state in which the heater fixing holder 60 is attached.

Figure 5:
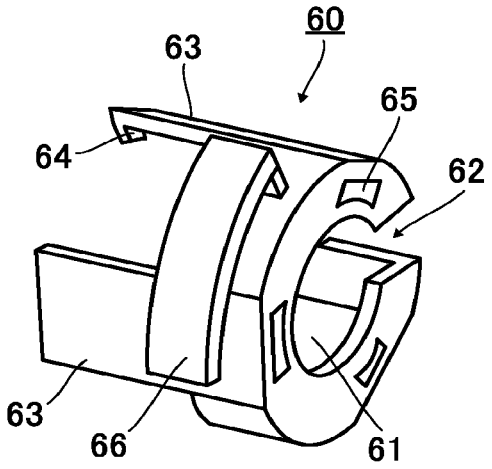
FIG. 5 is a front perspective view of an example of the heater fixing holder according to an embodiment of the present disclosure.
Figure 6:
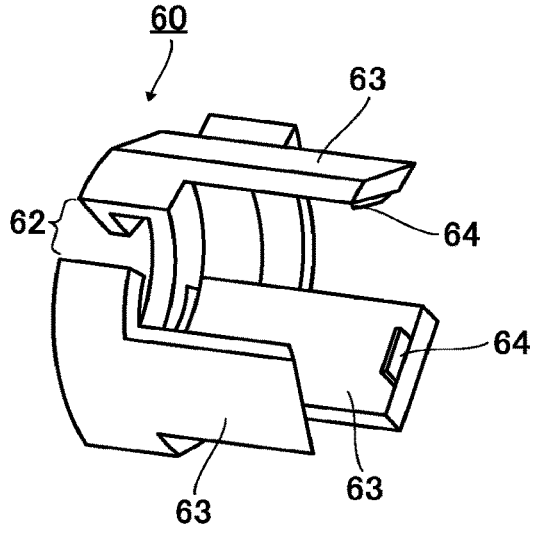
FIG. 6 is a rear perspective view of an example of the heater fixing holder according to an embodiment of the present disclosure.
Figure 7:
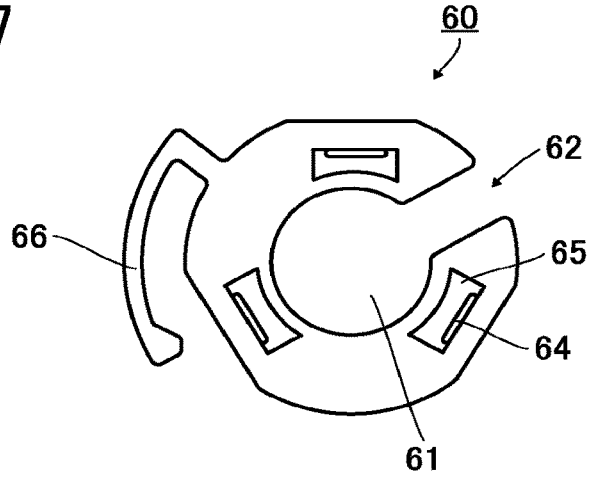
FIG. 7 is a front view of an example of the heater fixing holder according to an embodiment of the present disclosure.
Figure 8:
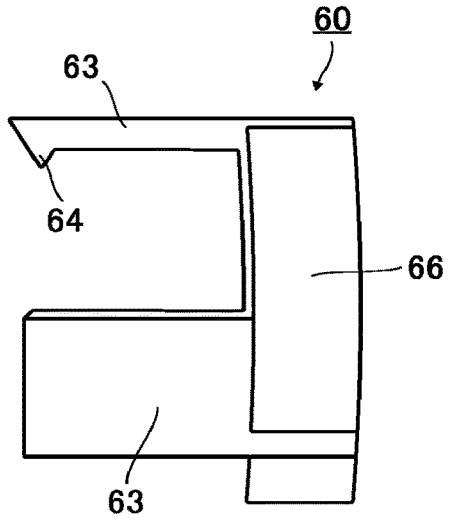
FIG. 8 is a side view of an example of the heater fixing holder according to an embodiment of the present disclosure.

FIG. 5 is a front-side perspective view of the heater fixing holder 60. FIG. 6 is a rear-side perspective view of the heater fixing holder 60. FIG. 7 is a front view of the heater fixing holder 60. FIG. 8 is a side view of the heater fixing holder 60.

The image forming apparatus 100 and the fixing device 1 of the present embodiment includes the heater fixing holder 60 to protect the heater 50 without removing the heater 50 when a member of the fixing device 1 is replaced.

The heater fixing holder 60 is a member removably attached to the heating roller 51 and the heater 50 disposed inside the heating roller 51. The heating roller 51 constitutes part of the fixing device 1 that fixes an image onto a recording medium P.

The heater fixing holder 60 includes at least a fitting portion 61 and gripping portions 63. An end portion (base portion) of the heater 50 penetrates through the fitting portion 61 and fits with the fitting portion 61. The gripping portions 63 hold an outer peripheral surface of the heating roller 51. The heater fixing holder 60 holds and fixes the heater 50 at a position at which the heater 50 does not contact an inner wall of the heating roller 51.

The heater 50 is preferably fixed and held with the heater fixing holder 60 at a position at which a rotation axis of the heater 50 and the rotation axis of the heating roller 51 overlap with each other (a position at which the center of a vertical cross section of the heater 50 matches or is in proximity to the rotation axis of the heating roller 51).

As illustrated in FIG. 3, the heater 50 includes a tubular portion 50*a*, a base portion 50*b*, and a base end portion 50*c*. The tubular portion 50*a* includes a heating element sealed inside the tubular portion 50*a*. The base portion 50*b* seals a longitudinal end portion of the tubular portion 50*a*. The base end portion 50*c* having a small sectional area is disposed on a longitudinally outer side from the base portion 50*b*. Heater elements 50*d* extend from an end face of the base end portion 50*c*. In the present embodiment, the number of tubular portions 50*a* is three, but not limited to the number.

The heater fixing holders 60 having the same shape are attached to both end portions of the heater 50 in the longitudinal direction, thus allowing the heater 50 to be positioned and fixed relative to the heating roller 51.

The heater 50 includes a harness connected to supply power.

A harness extending from the heater 50 would complicate handling when the heater 50 is attached and detached or when the heater fixing holder 60 according to the present embodiment is attached and detached.

On the other hand, the heater fixing holder 60 of the present embodiment has at least one of a structure capable of supporting the harness and a cutout portion 62 and the like through which the harness can be inserted. Thus, the harness can be easily routed and handled.

The structure capable of supporting the harness is not particularly limited as long as the structure does not hinder the arrangement of the harness. For example, the structure includes windows 65 that are through-holes on a front surface side of the heater fixing holder 60 and an arm 66.

The heater fixing holder 60 preferably has a structure of gripping a plurality of locations at substantially equal intervals with respect to the outer peripheral surface of the heating roller 51.

The heater fixing holder 60 of the present embodiment, as illustrated in FIGS. 4 to 6, includes the three gripping portions 63 that grip the outer peripheral surface of the heating roller 51 at substantially equal intervals.

The term "substantially equal intervals" means, for example, that any one of gripping portions 63 is arranged at the same angle relative to the others of the gripping portions 63 in the circular shape of the opening cross section of the heating roller 51. In the above-described example in which the three locations are gripped, the outer peripheral surface of the heating roller 51 is gripped at substantially equal intervals by the gripping portions 63, each of which is arranged to form an angle of 120° relative to the other two gripping portions 63.

As illustrated in FIGS. 3 and 4, the heating roller 51 includes a groove portion 51*a* along the circumferential direction of the heating roller 51. The gripping portions 63 of the heater fixing holder 60 have claw portions 64 that engage with the groove portion 51*a* of the heating roller 51 by snap-fit.

As illustrated in FIGS. 4 to 8, the heater fixing holder 60 of the present embodiment has the claw portions 64 formed at end portions of the gripping portions 63. The positions and shape of the claw portions 64 are not particularly limited as long as the claw portions 64 function as engagement pieces engageable with the groove portion 51*a* by snap-fit, and can be designed and formed as appropriate.

Further, preferably a hook-and-loop fastener is provided on a surface of the heater fixing holder 60 that does not contact the heating roller 51 and the heater 50.

The hook-and-loop fastener of the heater fixing holder 60 can be detachably coupled to another hook-and-loop fastener provided at an arbitrary position in the image forming apparatus 100. Such an arrangement allows the heater fixing holder 60 to be held at the arbitrary position except during use.

MAGICTAPE (registered trademark), Velcro (registered trademark), and the like may be used as the hook-and-loop fastener. Note that other coupling members (for example, button, etc.) allowing attachment and detachment can also be employed instead of the hook-and-loop fastener.

For example, the heater fixing holder 60 may be stored in the vicinity of the space occupied by the waste toner tank 125 of the image forming apparatus 100 and vacated when the waste toner tank 125 is removed.

In such a case, another hook-and-loop fastener may be provided at a storage position at which the heater fixing holder 60 is stored in the image forming apparatus 100, thus allowing the hook-and-loop fastener to be coupled to the hook-and-loop fastener attached to the heater fixing holder 60.

When using the heater fixing holder 60, the heater fixing holder 60 can be taken out after the waste toner tank 125 is detached from the image forming apparatus 100 and the hook-and-loop fastener of the heater fixing holder 60 held at the storage position is decoupled from the other hook-and-loop fastener at the storage position of the image forming apparatus 100.

When a member of the fixing device 1 is replaced, the above-described configuration of the heater fixing holder 60 according to the present embodiment can prevent the heater 50 from contacting the heating roller 51 and being damaged even with the heater 50 being mounted. Thus, the attachment and detachment of the heater 50 can be obviated and the work efficiency can increase.

The method of fixing and holding a heater according to an embodiment of the present disclosure attaches the heater fixing holder 60 to the heating roller 51 and the heater 50. The heating roller 51 constitutes at least part of the fixing device 1 that fixes an image onto the recording medium P. The heater 50 is disposed inside the heating roller 51. The method secures and holds the heater 50 at a position at which the heater 50 does not contact an inner wall of the heating roller 51.

Such a method can prevent the heater 50 from being damaged when a member of the fixing device 1 is replaced. Thus, the attachment and detachment of the heater 50 can be obviated and the work efficiency can increase.

The fixing device 1 according to an embodiment of the present disclosure includes the fixing roller 52, the heating roller 51, the fixing belt 53, and the pressure roller 54. The heating roller 51 is heated by the heater 50. The fixing belt 53 is stretched at least around the fixing roller 52 and the heating roller 51. The pressure roller 54 is pressed against the fixing roller 52 to form a nip portion between the fixing belt 53 and the pressure roller 54 via the fixing belt 53. The heater fixing holder 60 according to an embodiment of the present disclosure of the present disclosure is attached on the heating roller 51 and the heater 50.

Further, the image forming apparatus 100 according to an embodiment of the present disclosure includes the fixing device 1. The fixing device 1 includes the fixing roller 52, the heating roller 51, the fixing belt 53, and the pressure roller 54. The heating roller 51 is heated by the heater 50. The fixing belt 53 is stretched at least around the fixing roller 52 and the heating roller 51. The pressure roller 54 is pressed against the fixing roller 52 to form a nip portion between the fixing belt 53 and the pressure roller 54 via the fixing belt 53. The heater fixing holder 60 according to an embodiment of the present disclosure is attached on the heating roller 51 and the heater 50. In the above descriptions, the term "printing" in the present disclosure may be used synonymously with, e.g. the terms of "image formation", "recording", "printing", and "image printing". Further, the coater according to an embodiment of the present disclosure can also be applied to an apparatus that performs printing on an electrophotographic process on a sheet material coated with a coating liquid.

The suffixes Y, M, C, and K attached to each reference numeral indicate only that components indicated thereby are used for forming yellow, magenta, cyan, and black images, respectively, and hereinafter may be omitted when color discrimination is not necessary.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A heater fixing holder configured to be detachably attached to a heating roller having a heater inside the heating roller, the heating roller constituting at least part of a fixing device configured to fix an image onto a recording medium, the heater fixing holder comprising:

a fitting portion configured to be penetrated with and fit with an end portion of the heater, a gripping portion configured to hold an outer peripheral surface of the heating roller, and a hook-and-loop fastener on a surface of the heater fixing holder configured not to contact the heating roller and the heater, wherein the heater fixing holder is configured to hold and fix the heater at a position so that the heater does not contact an inner wall of the heating roller.

2. The heater fixing holder according to claim 1, wherein the heater fixing holder has a structure configured to support a harness connected to supply power to the heater.

3. The heater fixing holder according to claim 1 further comprising a notch portion through which a harness connected to supply power to the heater is insertable.

4. The heater fixing holder according to claim 1, wherein the gripping portion is configured to hold the outer peripheral surface of heating roller at a plurality of locations arranged at substantially equal intervals.

5. The heater fixing holder according to claim 1, wherein the heating roller includes a groove portion along the outer peripheral surface of the heating roller in a circumferential direction of the heating roller, wherein the gripping portion includes a claw portion configured to engage with the groove portion of the heating roller by snap-fit.

6. A method of fixing and holding a heater with the heater fixing holder according to claim 1, the method comprising:

attaching the heater fixing holder to the heater disposed inside the heating roller of the fixing device configured to fix the image onto the recording medium; and fixing and holding the heater at the position at which the heater s configured not to contact an inner wall of the heating roller.

7. A fixing device comprising:

a fixing roller;

a heating roller including a heater configured to heat the heating roller;

a fixing belt stretched at least around the heating roller and the fixing roller;

a pressure roller configured to press against the fixing roller to form a nip portion between the fixing belt and the pressure roller via the fixing belt; and the heater fixing holder according to claim 1 attached on the heating roller and the heater.

8. An image forming apparatus, comprising:

a fixing device, and a heater fixing holder configured to be detachably attached to a heating roller having a heater inside the heating roller, the heating roller constituting at least part of a fixing device configured to fix an image onto a recording medium, the heater fixing holder including a fitting portion configured to be penetrated with and fit with an end portion of the heater, a gripping portion configured to hold an outer peripheral surface of the heating roller, wherein the heater fixing holder is configured to hold and fix the heater at a position so that the heater does not contact an inner wall of the heating roller, wherein the fixing device includes a fixing roller, a heating roller including a heater configured to heat the healing roller, a fixing belt stretched at least around the heating roller and the fixing roller; and a pressure roller configured to press against the fixing roller to form a nip portion between the fixing belt and the pressure roller via the fixing belt, wherein the heater fixing holder is configured to be attached to the heating roller and the heater;

wherein the image forming apparatus further comprises a waste toner tank detachably attached with respect to the image forming apparatus; and wherein the image forming apparatus is configured to accommodate and hold the heater fixing holder in a vicinity of a space occupied by the waste toner tank and vacated when the waste toner tank is detached.

* * * * *